US007494097B2

(12) United States Patent
Lidie et al.

(10) Patent No.: US 7,494,097 B2
(45) Date of Patent: Feb. 24, 2009

(54) METHOD AND TRANSPORTABLE CLAMPING APPARATUS FOR PREPARING MORTAR AND CEMENT MIXTURES ON BUILDING OR CONSTRUCTION SITES

(76) Inventors: Angelo M. Lidie, 2326 Cliff Dr., Redding, CA (US) 96001; Brandon Murray, 3845 Pegasus St., Redding, CA (US) 96002

( * ) Notice: Subject to any disclaimer, the term of this patent is extended or adjusted under 35 U.S.C. 154(b) by 216 days.

(21) Appl. No.: 11/431,009

(22) Filed: May 10, 2006

(65) Prior Publication Data

US 2006/0261222 A1 Nov. 23, 2006

Related U.S. Application Data

(60) Provisional application No. 60/741,077, filed on Dec. 1, 2005, provisional application No. 60/682,235, filed on May 17, 2005.

(51) Int. Cl.
*A47G 29/00* (2006.01)

(52) U.S. Cl. ..... 248/126; 248/146; 248/149; 248/154; 248/346.01

(58) Field of Classification Search ..... 248/154, 248/126, 146, 149, 346.01; 81/3.32, 3.42; 366/129
See application file for complete search history.

(56) References Cited

U.S. PATENT DOCUMENTS 1,227,738 A * 5/1917 Bellis et al. ..... 81/3.32
1,246,491 A * 11/1917 Thayer ..... 81/3.42
1,260,157 A * 3/1918 Denton ..... 165/80.1
2,199,516 A * 5/1940 Yeatts ..... 81/3.32
2,799,189 A * 7/1957 Goodman, Sr. ..... 81/3.32
3,208,314 A * 9/1965 Locke ..... 81/436
3,301,103 A * 1/1967 Shultz et al. ..... 81/3.32
4,365,925 A * 12/1982 Girtz ..... 414/684.3
4,877,208 A 10/1989 Kennard, Jr.
5,232,188 A 8/1993 Troncone
6,464,184 B1 * 10/2002 Lytle ..... 248/126
6,779,915 B2 8/2004 Foster, Jr.
6,942,191 B2 9/2005 Zagorsky
2003/0016586 A1 1/2003 Williams
2003/0189873 A1 10/2003 Moore
2004/0084599 A1 5/2004 Tedesco et al.
2005/0045780 A1 3/2005 Forshee et al.
2005/0213424 A1 9/2005 Peterhans

* cited by examiner

*Primary Examiner*—Korie Chan
(74) *Attorney, Agent, or Firm*—Jones, Tullar & Cooper, PC

(57) ABSTRACT

A bucket clamp assembly receives and supports a five gallon bucket securely in place while the user mixes slurry-like products. The bucket is preferably inserted into the clamp assembly on the ground. The user places the bucket on a base plate between a fixed front support and an opposing hinged rear support and firmly against the hinged rear support, thereby raising a lever arm operating the hinged support to an open position. The user then presses her or his right foot firmly down on the exposed upper surface of the base plate and places the left foot across the lever arm. The clamp is thereby securely pressed to the ground using the worker's body weight. Further pressing the left foot down across the lever arm also forces the hinged rear clamp support surface to swing distally or forwardly, thereby firmly squeezing the sides of the bucket against the opposing, fixed clamp support, securing the bucket in place for safe and efficient mixing.

10 Claims, 6 Drawing Sheets

METHOD AND TRANSPORTABLE CLAMPING APPARATUS FOR PREPARING MORTAR AND CEMENT MIXTURES ON BUILDING OR CONSTRUCTION SITES

RELATED PATENT APPLICATION AND PRIORITY CLAIM INFORMATION

This application claims priority to and is owned by the applicant/owner of (1) provisional application No. 60/682,235, filed May 17, 2005 and (2) provisional application No. 60/741,077, filed Dec. 1, 2005, the entire disclosures of which are incorporated herein by reference.

BACKGROUND OF THE INVENTION

1. Field of the Invention

The present invention relates to in-situ methods and transportable tools for preparing slurries such as mortar and cement mixtures on building or construction sites.

2. Discussion of the Prior Art

Those working on building or construction sites often are required to mix slurries such as mortar or cement for use in a specific location and at a particular time. Often, it required that workers expend hours in mixing cement or mortar in a five (5) gallon plastic bucket using a hand-held industrial drill with a four-inch (4") paddle blade.

One problem is that while mixing, for example, dry powder cement into a slurry with water, the cement clumps up at the bottom of the bucket. The torque of the drill then spins the bucket, making the bucket very hard to keep steady. A spinning bucket's handle can strike the worker's shins and then the spinning bucket spills the slurry from the bucket, making a mess and wasting the material.

The traditional field-expedient method to hold the bucket while mixing is to straddle both sides of a bucket with one's feet. When straddling the bucket at a slight squat, a worker can squeeze his or her knees at the bucket's top rim, and can then slowly start spinning drill, to mix the dry powder material into the water and form the desired slurry consistency. Once a soup-like texture is reached, only then can the rest of the dry powder be added. The right texture is needed, and this a back-wrenching, time consuming way to do the job. When dried or heavy material is encountered and the bucket is more likely to spin during stirring, the worker must attempt to increase the grasping force on the bucket with his or her knees. The only benefit to this method is that it makes use of plastic 5 gallon buckets (e.g., drywall mud buckets) which are often already on a construction site, and so is cost effective and expeditious from an equipment buying/carrying standpoint.

The prior art includes supports described in patents and pending applications which either (a) are expensive to produce, (b) are less effective when in use, or (c) are more bulky and so difficult to transport and place, before use. For example, the patent to Troncone, U.S. Pat. No. 5,232,188 A, shows a mixing pail jig with a generally circular support ring which can be distorted to a squeezing elliptical condition by stepping on opposing foot pads which are normally above the floor, but contact the floor when stepped on. The device includes a floor engaging support, but does not permit the bucket to rest on a bottom surface, when in use.

In the patent to Lytle, U.S. Pat. No. 6,464,184 B1, a canister retaining apparatus has an adjustable base and at least one (preferably two) opposing swing members are attached to the base. One end of the swing member is attached to the base via a hinge, and the other end of the swing member has a semicircular recess. A spring is used to keep the swing member in an open position, and it can be closed with applied force (e.g., by stepping on it). Since the retaining apparatus has a large planar base with a width greater than a bucket's diameter, the apparatus is bulky and large.

In the patent to Zagorsky, U.S. Pat. No. 6,942,191 B2, there is shown an ant rotation device for a barrel in which viscous material is being mixed or stirred. There is a substantially planar, generally rectangular, member which includes an aperture to accommodate the barrel. A clip at the end of a chain hooks to the barrel. Stepping on the rectangular member tightens the chain and clamps the barrel. An alternative embodiment has a hooked strip in place of the clip and chain. Zagorsky's device depends upon use of a chain or hooked member to secure the barrel or bucket, and so rough handling may knock off the hooked member when working and mixing the slurry, causing the spill mentioned above.

In Roebuck's U.S. Pat. No. 6,829,800, a product sold under the trademark "Bucket Brake Plus" provides a pry tool, a cutting tool and a rotation prevention tool contoured to provide a downward force using a buckets bail or handle, but does not provide any clamping force against the bucket's outer surface, and instead pulls downwardly from only one side using the bucket's bail. As a result, the Roebuck tool, while versatile, cannot provide a strong and controllable clamping force to a bucket, when mixing.

In the patent application to Tedesco et al., No. 2004/0084599 A1, there is shown a five gallon bucket vise which has jaws to grip the bucket. Two elastomeric bands face one another, and lever movement causes one band to move toward the other band, encircling the container at its base region, and a spring-loaded latch holds the force. The device has a trip release, and a person can stand on the device. In an alternative design, the container is cornered between two fixed stops, and the lever moves a third stop. Tedesco's vise has several moving parts (making it expensive to produce) and provides a large bulky platform that is difficult to carry and place on a construction site.

In the patent application to Forshee et al., No. 2005/0045780 A1, a device with a tapered ring engages a bucket in a friction for use mixing. The ring-like socket has opposing wings for the worker's feet, which press the retainer against the floor or other support surface, but apart from the "friction fit" provides no secure clamping force and no mechanism to increase clamping force, when needed.

There is a need, therefore, for a method and inexpensive, portable apparatus for preparing mortar and cement mixtures on building or construction sites without creating undue stress on a worker's back, legs and shins, preferably while reducing mixing time and improving worker productivity.

OBJECTS AND SUMMARY OF THE INVENTION

Accordingly, it is a primary object of the present invention to overcome the above mentioned difficulties by providing a method and portable, inexpensive apparatus for preparing mortar and cement mixtures on building or construction sites without creating undue stress on a worker's back, legs and shins.

Another object of the present invention is reducing mixing time and improving worker productivity by providing an easy to use clamping tool which permits the user to modulate or adjust the clamping force applied, to meet varying situations.

Another object of the present invention is providing a transportable, easy to use clamping apparatus and method which permits the clamping force to be controllably applied near the base of a bucket when the bucket's weight rests on a flat or planar surface.

The aforesaid objects are achieved individually and in combination, and it is not intended that the present invention be construed as requiring two or more of the objects to be combined.

The bucket clamp assembly of the present invention avoids stressing the worker's back and reduces mixing time by using the weight of the worker to clamp and firmly hold the bottom of the bucket with a foot actuator that is easy to modulate or control and quick to release. The clamp assembly is easy to carry and place for use because it has a narrow, elongated rectangular and substantially planar steel base plate with a flat bottom surface opposite an upper surface carrying first and second spaced, arc-shaped bucket clamping supports.

The first or front clamping support is fixed, preferably made of steel and is curved or radiused along its inner surface to receive and grip the cylindrical outer surface of a cylindrical receptacle or bucket. The front clamp support is preferably a substantially planar segment of crescent shaped sheet or plate steel is fixedly supported above the plane of the base plate by a selected clearance height of, preferably, one half inch, and is positioned approximately three inches from the front or distal edge of the base plate. The front clamp support has its radiused or curved inner surface oriented to face the center of the base plate and defines a section of an imaginary circle shared by a second curved or radiused inner surface of a cooperating second or rear clamping support.

The rear clamping support is also preferably made of a substantially planar crescent shaped segment of steel sheet or plate welded to and carried by a hinged lever arm that is preferably made from an 8" long segment of 1" square section steel tube. The lever arm carries first and second upwardly projecting spaced parallel hinge pin supports, spaced, preferably, approximately two inches from the distal or front end of the lever arm. The first and second hinge pin supports each include a transverse aperture or bore aligned and dimensioned to receive a removable, substantially cylindrical latching hinge or slide pin, also made of steel or aluminum.

The base plate has first and second upwardly projecting stanchions or lever mounts welded in a parallel spaced relationship dimensioned to rotatably receive the lever arm's hinge pin supports. The base plate's lever mounts also each include a transverse bore aligned and dimensioned to receive the removable hinge pin.

Upon assembling the clamp parts, the latching hinge pin is slidably placed through the aligned bores or holes at the top of the mounts and lever hinge pin supports. This allows the lever arm to hingedly pivot or swing up & down freely (e.g., in response to a user's selected or modulated foot pressure), when placing a mortar or cement receiving bucket into the clamp assembly.

Preferably, the base plate is substantially planar and has an overall length that is less than thirty inches and a width that is less than ten inches, and is easily carried by the rigidly affixed front clamp support which provides a curved and easy to grasp handle or bail. The bucket clamp assembly may also be carried by the side of the base plate in one hand, leaving the other hand free to carry other tools or materials.

Preferably, the base plate includes a plurality of spaced mounting fastener receiving holes near the front edge for mounting the clamp assembly to a solid surface.

In use, the bucket clamp assembly receives and supports a five gallon bucket securely in place while the user mixes cement, glue or similar viscous, slurry-like products, and clamps the bucket firmly in place so as to be immovable even when mixing with high-torque tools such as an industrial drill mounted with a 4" mixing paddle. The bucket is preferably inserted into the clamp assembly on the ground when facing the user. This position is most effective. The user places a 5 gal. bucket upon the center of the base plate between opposing the clamp supports and firmly against the hinged rear clamp support, thereby raising the lever arm to an operating position. The user then presses her or his right foot firmly down across the distal exposed upper surface of the front of the base plate and places the left foot across the proximal or rear end of the lever arm. The clamp is thereby securely pressed to the ground using a selected or modulated pressure which can be as great as the worker's body weight. Further pressing the left foot down across the lever arm also forces the movable rear clamp support surface to swing distally or forwardly, thereby firmly squeezing the sides of the bucket against opposing, fixed clamp support 12. This secures the bucket in place by placing a selected clamping force against opposing sides of the bucket side wall near (e.g., approximately one half inch from) the bottom surface of the bucket for safe and efficient mixing.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Referring now to FIGS. 1-8, bucket clamp assembly 8 avoids stressing the worker's knees and back and reduces mixing time by using some or all of the worker's weight to clamp and firmly hold the bottom of the bucket with an actuator that is easy to modulate or control with a selected amount of clamping force and quick to release. The clamp assembly is easy to carry and place for use because of its narrow, elongated rectangular and substantially planar steel base plate 10 having a flat bottom surface opposite an upper surface carrying first and second spaced, arc-shaped bucket supports 12, 14.

Figure 1:
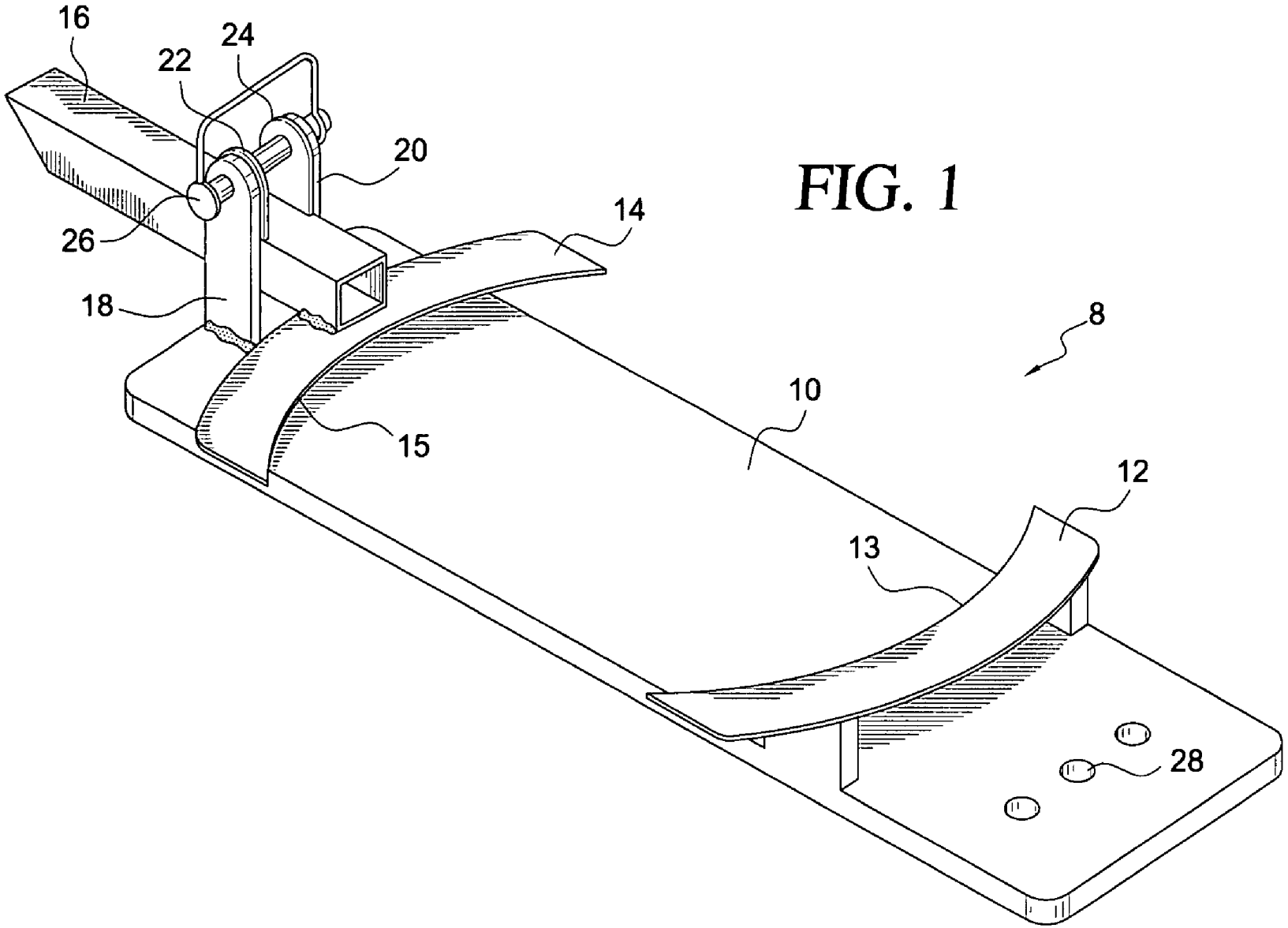
FIG. 1 is a perspective view, in elevation, of a bucket clamp assembly, in accordance with the present invention.
Figure 2:
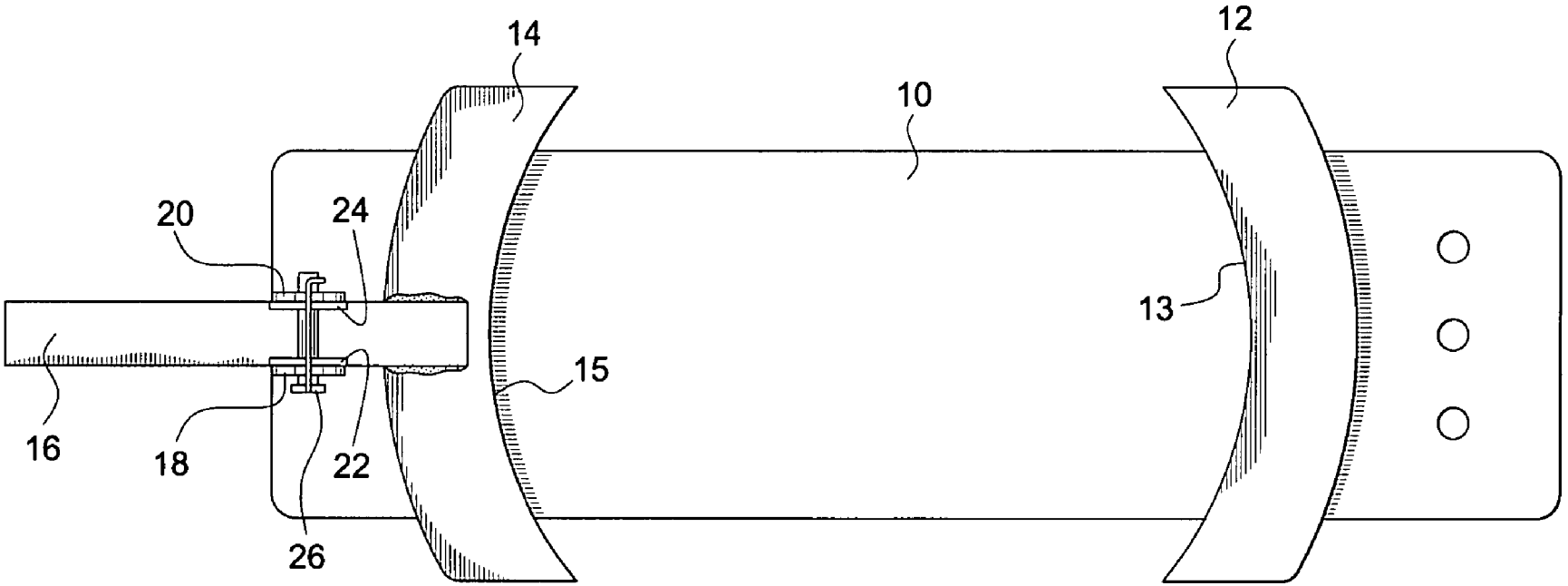
FIG. 2 is a top surface or plan view, in elevation, of the bucket clamp assembly of FIG. 1, in accordance with the present invention.
Figure 3:
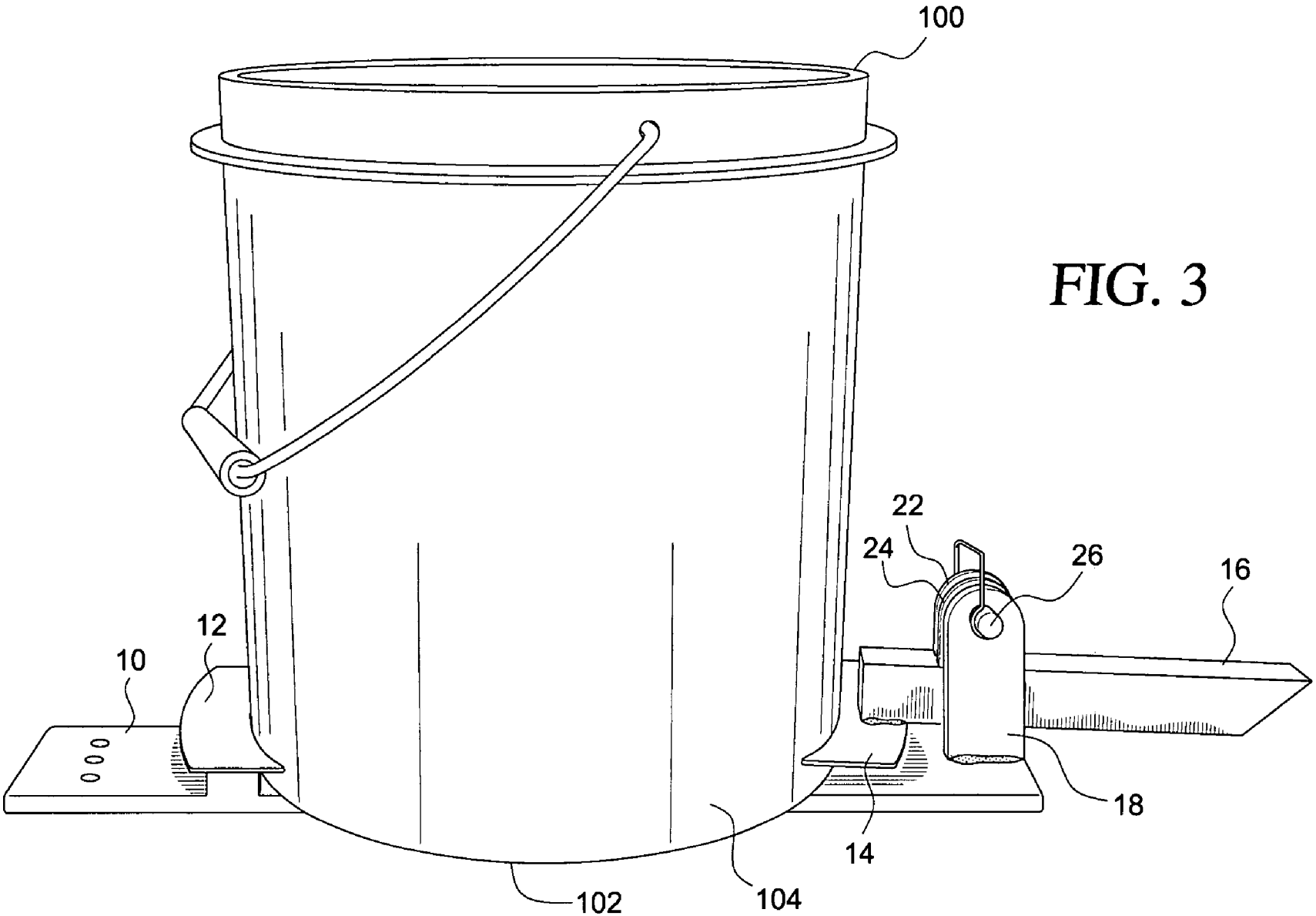
FIG. 3 is a side view, in elevation, illustrating the method for clamping a mixing bucket in the bucket clamp assembly of FIGS. 1 and 2, in accordance with the present invention.
Figure 4:
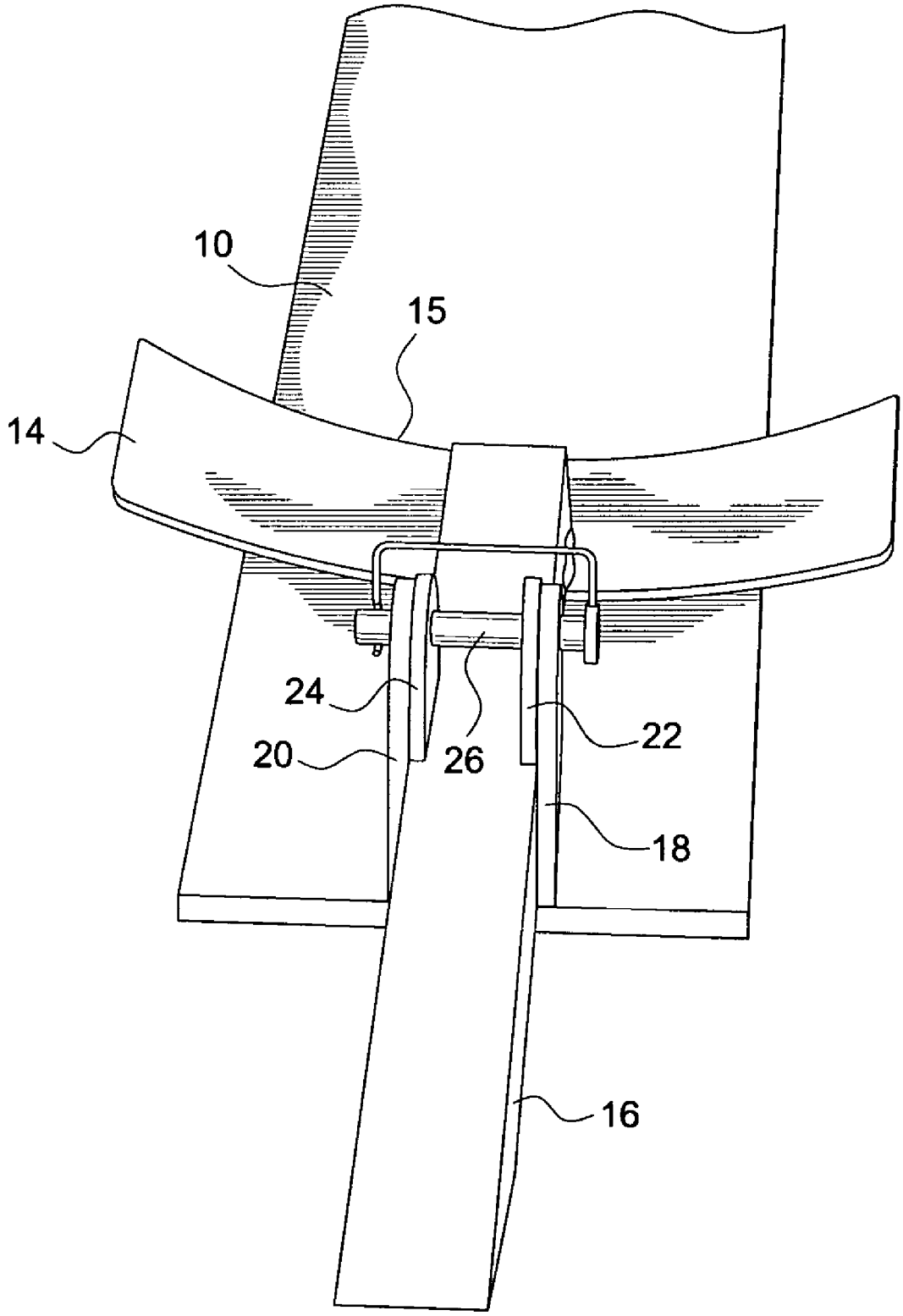
FIG. 4 illustrates a side view, from above, for the hingedly movable lever arm of the bucket clamp assembly of FIG. 1, in accordance with the present invention.
Figure 5:
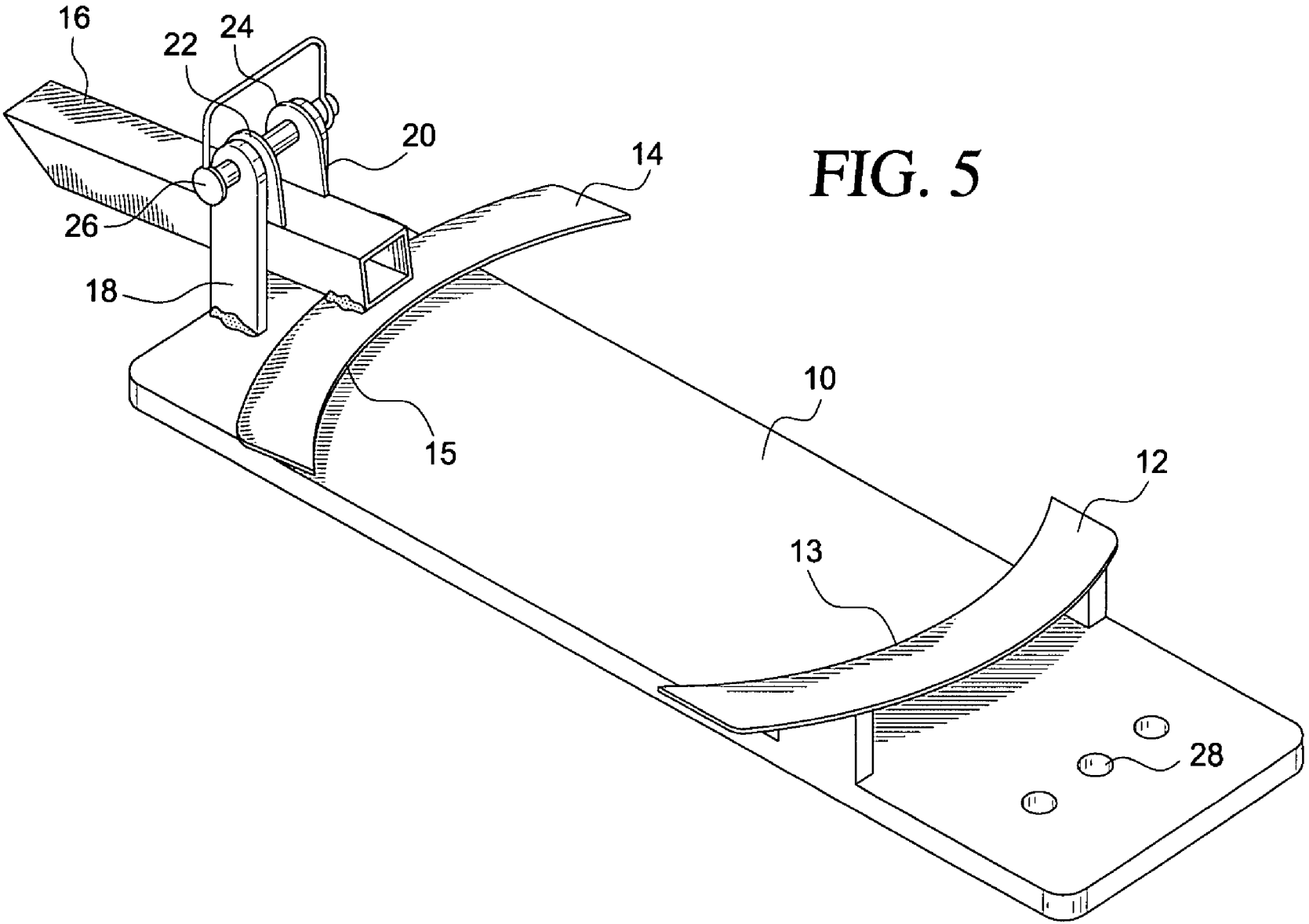
FIG. 5 is a perspective view illustrating the clamp open position for the bucket clamp assembly of FIGS. 1-4, in accordance with the present invention.

First or front clamp support 12 is also preferably made of steel and is curved or radiused along its inner surface 13 to receive and grip the cylindrical outer surface of the bucket (best seen in FIG. 3). Front clamp support 12 is preferably a substantially planar segment of sheet or plate steel fixedly attached or welded in situ, supported above the plane of base plate 10 by a selected clearance height of, preferably, one half inch, and is positioned approximately three inches from the front edge of base plate 10. Front clamp support 12 has its radiused or curved inner surface 15 oriented to face the center of base plate 10 and defines a section of a circle shared by a curved or radiused inner surface of a cooperating second or rear clamp support 14.

Second or rear clamp support 14 is also preferably made of a substantially planar segment of steel sheet or plate welded to and carried by a hinged foot pressure lever arm 16 that is preferably made from an 8" long segment of 1" square sectioned tube or hollow bar steel. Lever arm 16 carries first and second upwardly projecting spaced parallel tab shaped lever mounts or hinge pin supports 22, 24 that are fixed to or welded to lever arm 16, spaced, preferably, approximately two inches from the distal or front end of lever arm 16. The hinge pin supports 22, 24 each include a transverse bore or aperture aligned and dimensioned to receive a removable, substantially cylindrical latching hinge or slide pin 26. Pin 26 may also be a threaded bolt secured with a wing-nut fastener, and may be made from steel or aluminum.

Base plate 10 preferably carries first and second upwardly projecting stanchions or lever mounts 18, 20 welded, in a parallel spaced relationship to the sides of base plate 10 one inch apart, centered at the rear of base plate 10, in a spacing dimensioned to rotatably receive the lever arm's hinge pin supports 22, 24. Lever mounts 18, 20 also each include a transverse bore aligned and dimensioned to receive removable, substantially cylindrical hinge pin 26.

Upon assembling the clamp parts as shown in FIGS. 1-5, latching slide pin 26 is slidably placed through the aligned bores or holes at the top of lever mounts 18, 20 and lever hinge pin supports 22, 24. This allows lever arm 16 to hingedly pivot or swing up & down freely, when placing a mortar or cement receiving bucket 100 into the clamp assembly, as best seen in FIG. 3.

Preferably, base plate 10 includes a plurality of spaced mounting fastener receiving holes 28 near the front edge of base plate 10 to permit temporary nailing or for mounting the clamp assembly to a solid surface.

Preferably, base plate 10 is planar and has an overall front-to-rear length that is less than thirty inches and a width that is less than ten inches, and is easily carried by the rigidly affixed front clamp support 12 which provides a curved and easy to grasp handle or bail. The bucket clamp assembly 8 may also be carried by the side of base plate 10 in one hand, leaving the other hand free to carry other tools or materials.

In use, bucket clamp assembly 8 receives, supports and holds a five gallon bucket (e.g., standard plastic drywall mud bucket) 100. Clamp assembly 8 holds bucket 100 securely in place while the user mixes cement, glue or similar viscous, slurry-like products, and clamps the bucket firmly in place so as to be immovable even when mixing with high-torque tools such as an industrial drill mounted with a 4" mixing paddle. The user straddle's the bucket, with a first foot placed on the base plate's upper surface distally of front clamping support 12, and a second foot placed near lever arm 16. The user can then modulate or control the amount of clamping pressure applied to the bucket's side walls by selecting how much of the user's weight to apply to lever arm 16.

Figure 6:
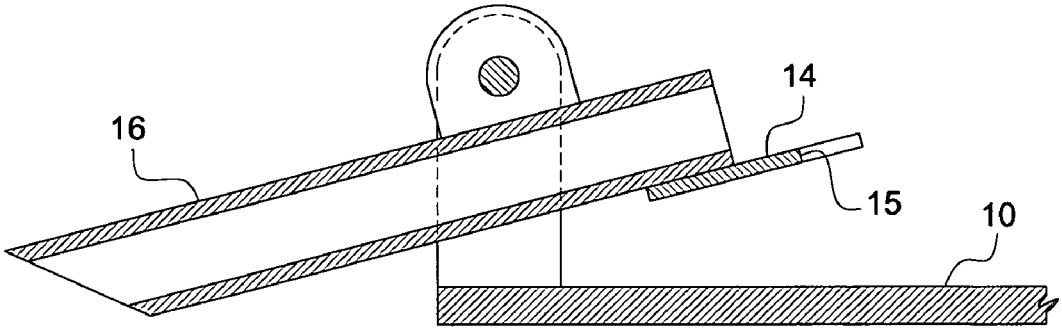
FIG. 6 illustrates, in partial section, the clamp extended position for the bucket clamp assembly of FIGS. 1-5, in accordance with the present invention.
Figure 7:
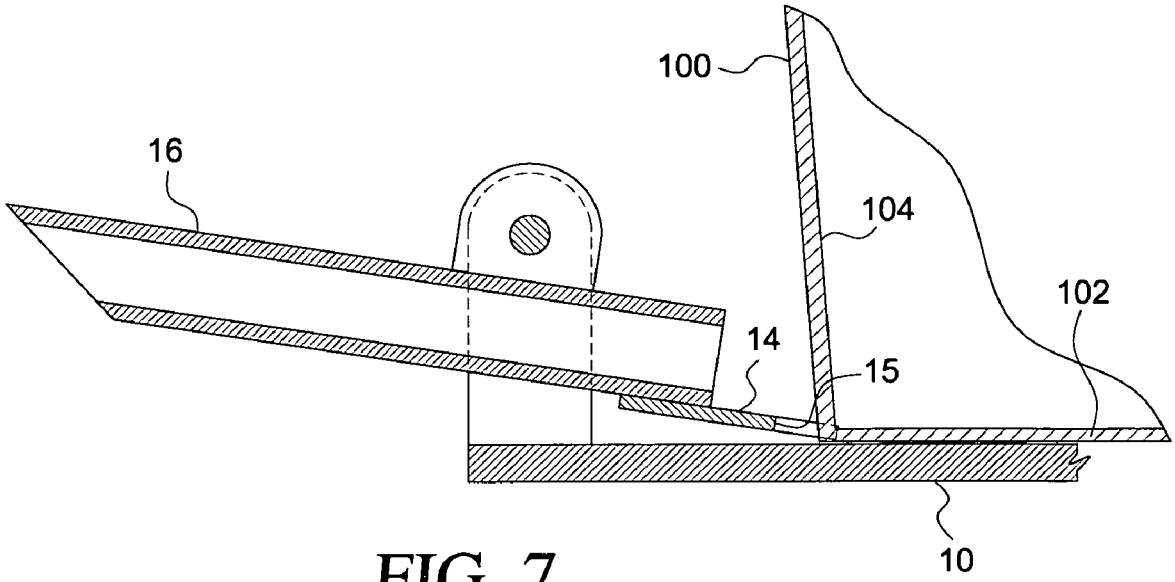
FIG. 7 illustrates, in partial section, the clamp open position with an inserted bucket or receptacle for the bucket clamp assembly of FIGS. 1-6, in accordance with the present invention.
Figure 8:
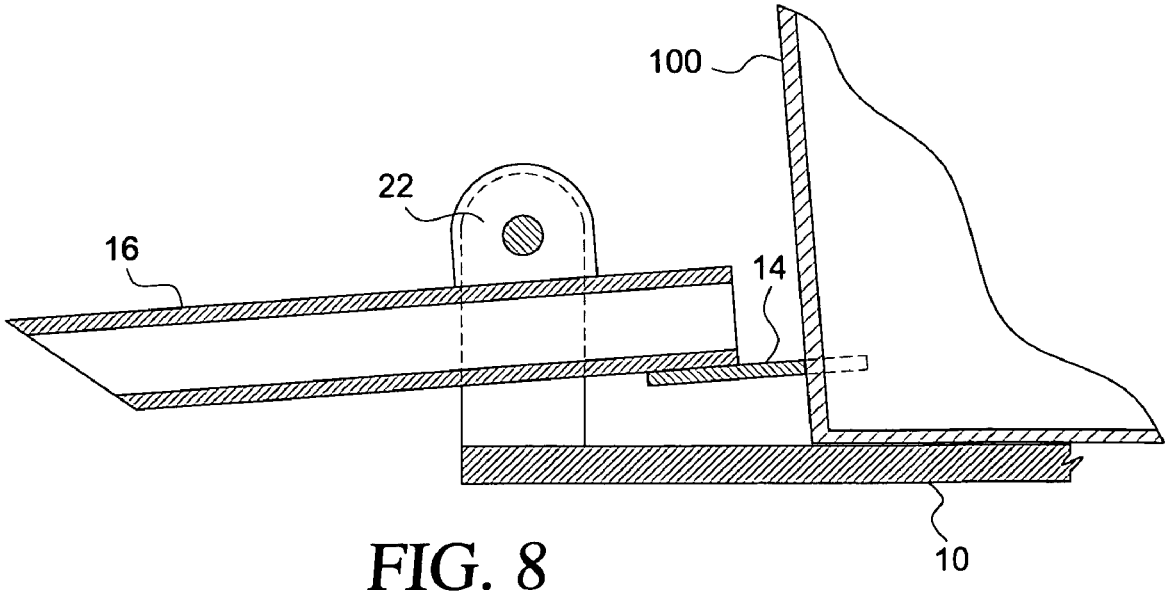
FIG. 8 illustrates, in partial section, the receptacle sidewall engaging position with an inserted bucket or receptacle for the assembly of FIGS. 1-7, in accordance with the present invention.

As shown in FIGS. 6, 7 and 8, bucket or receptacle 100 is preferably inserted into clamp assembly 8, e.g., when the clamp assembly is set down on the ground facing the user. This position is most effective. The user places a 5 gal. bucket 100 upon the center of base plate 10 between opposing clamp supports 12 and 14 and firmly against hinged clamp support 14, thereby raising lever arm 16 to an operating position, as shown in FIG. 7. The user then presses her or his right foot firmly down across the distal exposed upper planar surface of the front of base plate 10 places the left foot across the upper planar surface of the proximal or rear end of lever arm 16. The clamp is thereby securely pressed to the ground using as much of the worker's body weight as is comfortable and needed to prevent spinning (i.e., a selected amount of force). Further pressing the left foot down across lever arm 16 also forces clamp support surface 14 to swing distally or forwardly, thereby more firmly squeezing the lower sides of the bucket against opposing, fixed clamp support 12. Clamping with a selected clamping pressure at a short distance from the bucket's bottom 102 (e.g., between a half inch to two inches up the sidewall 104) secures the bucket in place for safe and efficient mixing.

Having described preferred embodiments of a new and improved method, it is believed that other modifications, variations and changes will be suggested to those skilled in the art in view of the teachings set forth herein. It is therefore to be understood that all such variations, modifications and changes are believed to fall within the scope of the present invention.

What is claimed is:

1. A transportable clamp assembly adapted to receive and to support a mixing receptacle, such as a five gallon bucket having a cylindrical receptacle wall, and to hold the receptacle securely in place during mixing of slurry-like products, said clamp assembly comprising:

an elongated substantially planar base plate having a base plate upper surface;

a first front clamping support member fixedly secured to said base plate and having a first arc-shaped inner clamping surface oriented to face a center of said planar base plate, said first inner clamping surface being sized to engage an outer surface of the cylindrical receptacle wall;

a second, opposing, hingedly movable rear clamping support member having a second arc-shaped inner clamping surface oriented to face said center of said planar base plate, said second inner clamping surface being sized to engage the outer surface of the cylindrical receptacle wall, said first inner clamping surface and said second inner clamping surface cooperating to define a section of a circle;

a lever arm having a proximal control surface and an opposing, distal rear clamping support member engagement surface; and means supporting said lever arm extends upwardly from said planar base plate to move said hingedly movable rear clamping support member and said second inner clamping surface between an open position and a closed, clamping position, said fixed front clamping support member first inner clamping surface being configured to clamp the receptacle in place when said second, hinpedly movable rear clamping member's second inner clamping surface swings in response to an application of a downwardly directed force on said proximal control surface of said lever arm to firmly squeeze the cylindrical wall of the receptacle during the mixing of the slurry-like products.

2. The transportable clamp assembly of claim 1, wherein said lever arm proximal control surface is configured to allow a user to apply a selected amount of foot pressure by application of a selected amount of the user's weight thereto to thereby apply a selectable amount of a clamping force to the cylindrical sidewall of the receptacle at a selected height above a bottom of the receptacle.

3. The transportable clamp assembly of claim 2, wherein said lever arm proximal control surface is configured as an upper planar surface of a rectangular section of steel tubing.

4. The transportable clamp assembly of claim 2, wherein said clamping force is applied to the sidewall of the receptacle at a selected height between one half inch and two inches above the bottom of the receptacle.

5. The transportable clamp assembly of claim 4, wherein said front clamping support member is configured to provide a clamping force at said selected height between one half inch and two inches above the bottom of the receptacle.

6. The transportable clamp assembly of claim 1, wherein said elongated substantially planar base plate has a front to back length of less than thirty inches and a transverse width of less than ten inches, to provide an easily transported assembly well suited for use in-situ on a construction site.

7. The transportable clamp assembly of claim 1, wherein said base plate and said front and rear clamping support members are metal.

8. The transportable clamp assembly of claim 7, wherein said metal is steel.

9. A method for receiving and supporting a bucket securely in place during mixing of slurry-like products in the bucket, said method including:

providing a clamp assembly including a substantially planar base plate carrying a first fixed front clamping support member having a first arc-shaped inner clamping surface oriented to face a center of said planar base plate and a second, opposing, hingedly movable rear clamping support member having a second arc-shaped inner clamping surface oriented to face said center of said planar base plate;

providing a lever arm;

providing a means supporting said lever arm extending upwardly from said planar base plate to move said second hingedly movable rear clamping support member therewith;

using said lever arm for moving said hinged clamping support surface between an open position and a closed, clamping position;

configuring said fixed front clamping support member for supporting and fixedly clamping the receptacle in place in response to swinging of said hinged rear clamp support surface for moving said first and second arc-shaped inner clamping surfaces toward each other for firmly clamping the sides of the bucket;

inserting the bucket into said clamp assembly by placing the bucket on said base plate between said fixed front support and said opposing hingedly movable rear support and firmly against said hingedly movable rear support;

raising said lever arm and moving said hingedly movable rear support to said open position;

pressing a user's first foot downwardly on an exposed upper surface of the base plate; and pressing a user's second foot across said lever arm, for pressing said clamp assembly to the ground.

10. The method of claim 9, further including:

further pressing the second foot down across said lever arm and applying a selected amount of clamping force for forcing said second hingedly movable rear clamping support member to swing with respect to said first fixed clamping support member for firmly forcing a side of the bucket against said opposing, fixed front clamping support, and securing the bucket in place in said clamp assembly.

* * * * *